United States Patent [19]

Debs

[11] 4,261,408

[45] Apr. 14, 1981

[54] TRAVERSE CORD LOCK FOR VERTICAL BLIND

[75] Inventor: Victor Debs, Staten Island, N.Y.

[73] Assignee: Levolor Lorentzen, Inc., Hoboken, N.J.

[21] Appl. No.: 48,221

[22] Filed: Jun. 13, 1979

[51] Int. Cl.[3] ..... E06B 9/26

[52] U.S. Cl. ..... 160/176 B

[58] Field of Search ..... 160/166–178

[56] References Cited

U.S. PATENT DOCUMENTS 3,343,588 9/1967 Cayton ..... 160/176

3,996,988 12/1976 de Wit ..... 160/176

4,122,884 10/1978 Salzmann ..... 160/176

*Primary Examiner*—Peter M. Caun

[57] ABSTRACT

In a vertical blind with a blind head, a tilt rod for tilting vanes suspended from the blind head in carriers, and a traverse cord for reciprocating the carriers in the head to thereby open and close the blind: a lever connected to the tilt rod for rotation therewith and having an opening spaced from the tilt rod and through which the traverse cord passes. Rotation of the tilt rod will bend and squeeze the traverse cord and thereby prevent its reciprocation when the vanes of the blind are tilted closed.

6 Claims, 8 Drawing Figures

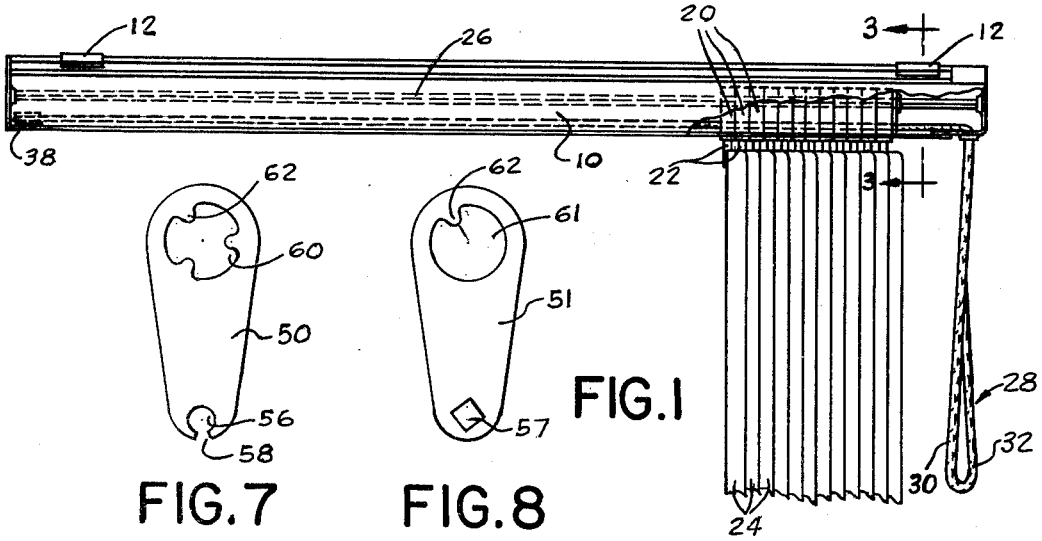
FIG.1
FIG.7
FIG.8
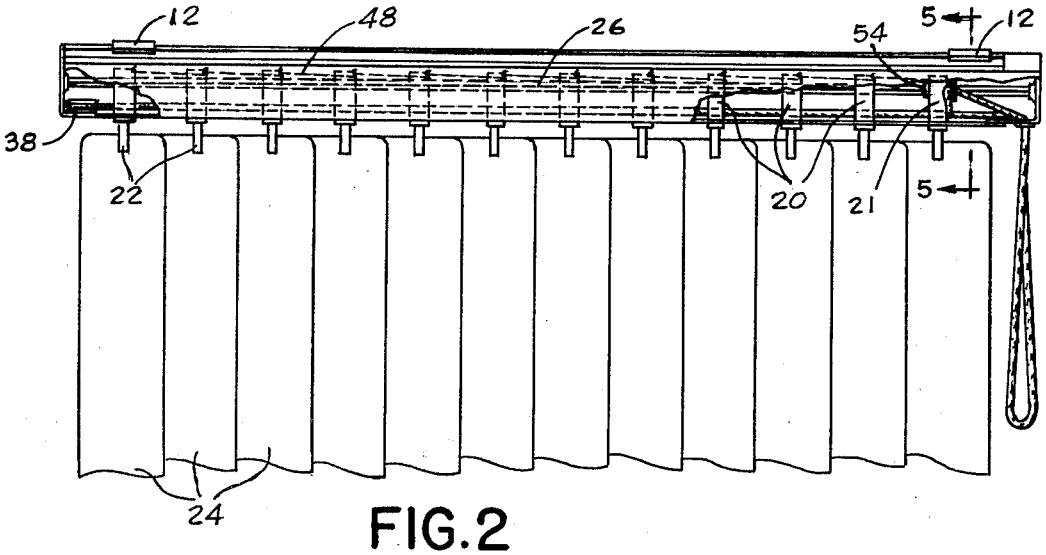
FIG.2
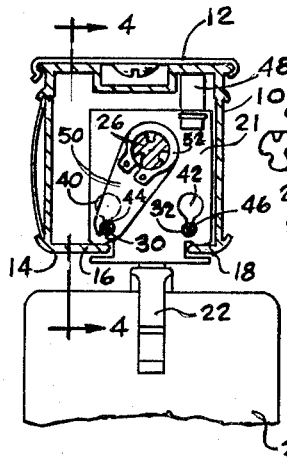
FIG.3
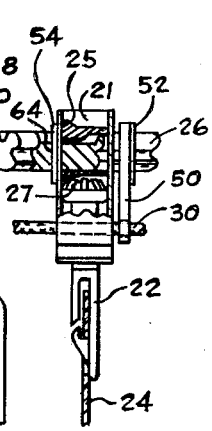
FIG.4
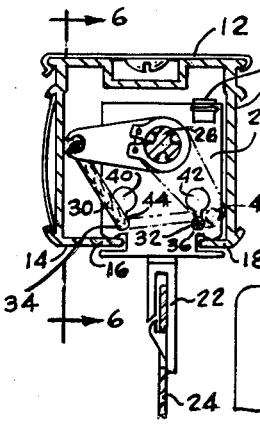
FIG.5
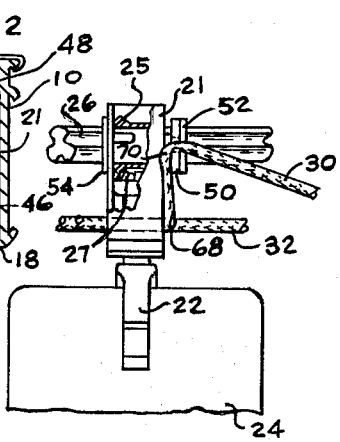
FIG.6

TRAVERSE CORD LOCK FOR VERTICAL BLIND

BACKGROUND OF THE INVENTION

The present invention relates to vertical blinds, and more specifically, to means for preventing the draw or traverse cord of a vertical blind from being operated with the vanes tilted in a certain position. The invention is intended to overcome a problem that arises with conventional vertical blinds when a person tries to pull the traverse cord and thereby traverse the vanes of a vertical blind while the blind is tilted closed. The edges of the vanes may then engage the vane holders of adjacent vanes and either become bent out of shape or the vane holders may be damaged and broken.

It is, therefore, an object of the present invention to provide means for preventing drawing of the blind traverse cord when the blind is in tilted closed position.

It is another object of the present invention to provide means of this type which do not, however, interfere with the normal operation of the blind, that is traversing of the blind when the same is tilted open, or semi-open.

BRIEF SUMMARY OF THE INVENTION

The problem underlying the invention has been solved by providing a lever or the like on the tilt rod of the vertical blind, which lever moves the draw cord from a position in which it can easily be pulled to a position in which it is bent twice by an angle of approximately 90 degrees each, thus making it virtually impossible to traverse the blind even when a great force is exerted by the person pulling the cord.

BRIEF DESCRIPTION OF THE DRAWINGS

The invention is illustrated, by way of example, in the attached drawings, in which:

FIG. 1 is a front view of a vertical blind in completely traversed open position;

FIG. 2 is a front view of the vertical blind of FIG. 1, but in completely traversed closed and tilted closed position;

FIG. 3 is a section taken along the line 3—3 of FIG. 1;

FIG. 4 is a partial section taken along the line 4—4 of FIG. 3, the blind head having been omitted for reasons of clarity;

FIG. 5 is a section taken along the line 5—5 of FIG. 2 and shows the traverse cord in the position in which it cannot be moved;

FIG. 6 is a partial section taken along the line 6—6 of FIG. 5;

FIG. 7 illustrates the lever for moving the draw cord, on a scale larger than that of FIGS. 3 and 5; and FIG. 8 is an alternative embodiment of the lever of FIG. 7.

DETAILED DESCRIPTION OF PREFERRED EMBODIMENTS

Referring now to the drawings in detail, FIG. 1 is a front view of a vertical blind having a blind head 10 which is suspended from a ceiling or other support by means of brackets 12. As shown in FIGS. 3 and 4, blind head 10 is provided with a bottom 14 forming two parallel tracks 16, 18 for a number of carriers 20 slidingly supported on tracks 16 and 18, and for a stationary carrier 21.

Each carrier 20, 21 is provided with a vane holder 22 which in turn supports a vane or louver 24. The head of the vertical blind is also provided with a tilt rod 26 extending from one end of the head to the other. A bevel gear 25 is mounted in each carrier on the rod 26 for rotation therewith, and a bevel gear 27 is integral with holder 22 for meshing engagement with gear 25. Elements 20, 22 and 24 to 27 are not described in great detail in this application since they are not necessary for an understanding of the invention. However, reference is made to Applicant's co-pending patent applications Ser. Nos. 921,048, filed June 30, 1978 and 002,457, filed Jan. 10, 1979. The arrangement of the carriers and tilt rod is such that upon rotation of tilt rod 26 by well known means, such as a wand or tilt cord, from the position shown in FIG. 3 to that shown in FIG. 5, the vane 24 will be tilted by approximately 90 degrees from the position shown in FIG. 3 to that shown in FIG. 5.

The carriers 20 can be moved along the tracks 16, 18 by means of a traverse cord 28 having two strands 30 and 32 which depend from one end of the vertical blind head, that is the right end in the embodiment shown in FIGS. 1 and 2. The two strands extend through openings 34 and 36, respectively, in the carriers 20, 21 and around a return pin or reel 38 in head 12. The cord 28 may be made from any suitable material, such as, for instance, polyester or similar material. It is placed in the openings 34 and 36, respectively, by first being passed through larger openings 40 and 42 and then pressed downwardly through gradually narrowing passages 44 and 46 into the openings 34 and 36. Adjacent carriers 20 are interconnected by spacers 48. One end of each spacer 48 is fixedly connected to a carrier 20 and the other end is essentially hook-shaped and is adapted to pass through a slot in an adjacent carrier 20. In operation, when the blind is being closed the vanes are moved from the position shown in FIG. 1 to the left, to the position shown in FIG. 2. The carrier 20 furthest to the left will be pulled to the left first, will then depending on the length of the spacer 48 be engaged by the hook-shaped end of the spacer and will take along the second carrier 20, and after a certain distance the second carrier 20 will, by way of its spacer band 48, pull the next carrier 20 along, and so on.

All of the elements 10 to 48 described so far have already been described in greater detail in Applicant's above-mentioned two copending U.S. patent applications Ser. Nos. 921,048 and 002,457, and the description therein is incorporated here by reference.

In accordance with the present invention there is provided a lock for automatically locking the traverse cord 28 when the blind is in the tilted closed position shown in FIG. 2, so that from this position the traverse cord cannot be pulled until the vanes have at least been partially tilted open from the position shown in FIG. 2, by turning the tilt rod 26. More specifically, adjacent the last or stationary carrier 21, that is is the one closest to where the traverse cord 28 is suspended from blind head 10, there is provided a lever 50. Carrier 21 is held stationary, that is prevented from moving along tilt rod 26 by a retainer ring 54. All other carriers 20 are movable along the tilt rod 26 and do not have retainer rings 54 associated therewith.

The lever 50 is provided with an opening 56 which is adapted to receive one of the strands 30 or 32 of the traverse cord 28. In the embodiment shown in FIGS. 3, 5 and 7, the cord may be pressed through a relatively narrow slot 58 into opening 56. However, the invention is not limited to this particular embodiment, but different forms of openings for the traverse cord may be used. One additional embodiment is shown in FIG. 8 in which the lever 51 is provided with a square opening 57. In this particular instance no slot for introducing the traverse cord is provided, but the cord would be pulled through the opening 57 after having been passed through the openings 34 in the carriers 20, 21 during assembly.

Lever 50 is also provided with an opening 60 which may conform to the shape of the tilt rod 26 or it may be a substantially circular opening 61 as shown in FIG. 8. It is, however, essential that the lever be provided with a key 62 adapted to engage a correspondingly shaped groove 64 in tilt rod 26 (FIG. 6). This key 62 fixes the position of the lever with respect to the tilt rod and assures that the lever is connected for rotation with the tilt rod. A split retainer or spring ring 52 is positioned on rod 26 and prevents the lever 50 from moving longitudinally of the tilt rod beyond a predetermined distance from carrier 21.

As will be evident from FIGS. 3 and 5, upon rotation of the tilt rod 26 from the position shown in FIG. 3 to that shown in FIG. 5, the lever 50 will move the traverse cord strand 30 from its approximately straight line path shown in FIG. 4 upwardly by an angle of about 80 degrees to the position shown in FIG. 5 so that two essentially right angle turns develop at 68 and 70 (see FIG. 6). The strand 30 also becomes squeezed between lever 50 and carrier 21. It will be obvious that if a person tries to pull at traverse cord 28 the same will not move and will not displace the carriers 20 from their positions shown in FIG. 2 since even a great force will not permit movement of the cord strand 30 through the two right angle turns 68 and 70. Only after the tilt rod has been tilted back counter-clockwise from the position shown in FIG. 5 to a semi-open or fully-open position, will it be possible to pull the cord strand 30 again through the openings 56 and 34, 36.

In this way a very effective traverse cord lock has been provided which will prevent drawing of the vertical blind when the vanes of the blind are closed.

The traverse cord lock described above is also effective when the vertical blind is tilted closed by turning the tilt rod 26 counter-clockwise, as indicated in dot-dash lines in FIG. 5. In this instance, not only will the cord strand 30 become squeezed between lever 50 and carrier 21, but also the cord strand 32.

I claim:

1. In a vertical blind having a blind head, a tilt rod rotatably supported in said head, a plurality of carriers supported in said head and of which at least some are longitudinally reciprocably supported in said head, a plurality of vane holders respectively rotatably supported in said carriers, means connecting said vane holders to said tilt rod for rotation therewith, means operatively connected to said tilt rod for rotating the same and thereby said vane holders, and traverse cord means having two interconnected strands, each operatively connected to said plurality of carriers such that reciprocation of said cord will reciprocate said reciprocable carriers: means connected to said tilt rod for rotation therewith and including means for engaging one of said strands of said traverse cord such that rotation of said tilt rod through a predetermined angle of rotation will bend said engaged portion of said strand and prevent reciprocation of said cord.

2. The combination of claim 1, wherein said means connected to said tilt rod is a lever mounted on said tilt rod adjacent one of said carriers.

3. The combination of claim 2, wherein said one carrier is longitudinally non-reciprocable supported in said head.

4. The combination according to claim 2, wherein said lever is provided with an opening spaced from said tilt rod for receiving said cord strand.

5. The combination according to claim 2, 3 or 4, wherein said lever is longitudinally spaced from said one carrier a distance sufficient such that upon rotation of said tilt rod through said predetermined angle of rotation said engaged traverse cord strand becomes squeezed between said lever and said one carrier.

6. The combination according to claim 5, wherein said lever is provided with a further opening for receiving said tilt rod, said tilt rod having a groove, and said lever having means for engaging said groove to thereby fix the position of said lever relative to said tilt rod.

* * * * *